US007632217B2

(12) United States Patent
Rooney

(10) Patent No.: US 7,632,217 B2
(45) Date of Patent: Dec. 15, 2009

(54) FACIAL EXERCISE MASK

(76) Inventor: Bryan Rooney, 7245 Hillside Ave., Apt. 422, Los Angeles, CA (US) 90046

( * ) Notice: Subject to any disclaimer, the term of this patent is extended or adjusted under 35 U.S.C. 154(b) by 238 days.

(21) Appl. No.: 11/225,271

(22) Filed: Sep. 13, 2005

(65) Prior Publication Data

US 2007/0060447 A1 Mar. 15, 2007

(51) Int. Cl.
*A63B 23/025* (2006.01)

(52) U.S. Cl. ..... 482/10; 482/148; 482/11; 128/76 B; 172/119

(58) Field of Classification Search ..... 482/10–11, 482/148; 272/95; 128/76 B, 76 R, 857–858, 128/863, 206.19, 201.25–201.28; 172/119; 607/109; 2/206–207; 433/136; 446/27, 446/11

See application file for complete search history.

(56) References Cited

U.S. PATENT DOCUMENTS

| | | | | | |
|---|---|---|---|---|---|
| 299,372 | A | * | 5/1884 | Rhoden | 106/157.2 |
| 2,002,449 | A | * | 5/1935 | Dohm | 604/303 |
| 2,134,640 | A | * | 10/1938 | Merkin | 606/204.35 |
| 2,728,339 | A | * | 12/1955 | Elmhirst | 606/204.15 |
| 3,211,146 | A | * | 10/1965 | Rodelli | 604/303 |
| 4,189,141 | A | * | 2/1980 | Rooney | 482/11 |
| 4,571,787 | A | * | 2/1986 | Furutsu | 24/543 |
| 4,574,787 | A | | 3/1986 | Jacobs | |
| 4,666,148 | A | * | 5/1987 | Crawford | 482/11 |
| 4,823,778 | A | | 4/1989 | Ewing | |
| 4,892,092 | A | | 1/1990 | Klein | |
| 5,192,254 | A | | 3/1993 | Young | |
| 5,484,359 | A | | 1/1996 | Wabafiyebazu | |
| 5,728,028 | A | * | 3/1998 | Dusch | 482/11 |
| 5,809,572 | A | * | 9/1998 | Sisolak | 2/173 |
| 6,013,094 | A | * | 1/2000 | De Cubber et al. | 606/204.15 |
| 6,152,857 | A | | 11/2000 | Gonzalez | |
| 6,179,747 | B1 | | 1/2001 | Kelley | |
| 6,248,043 | B1 | | 6/2001 | Morton | |
| 6,277,053 | B1 | | 8/2001 | Desembrana | |
| 2004/0209744 | A1 | * | 10/2004 | Tsujimoto | 482/83 |
| 2006/0135319 | A1 | * | 6/2006 | Berman | 482/11 |

OTHER PUBLICATIONS

Nitsusen, www.babelface.com, p. 2.*
Website URL: http://www.nissen.co.jp/sho_item/regular/1096/1096_49755.asp?book=1096&cat=cate008&bu=5912&thum=cate008_009_016_000-01.
Website Translation of the Website URL: http://www.nissen.co.jp/sho_item/regular/1096/1096_49755.asp?book=1096&cat=cate008&bu=5912&thum=cate008_009_016_000-01.

* cited by examiner

*Primary Examiner*—Lori Amerson
(74) *Attorney, Agent, or Firm*—Edwin Tarver; Robert J. Lauson; Lauson & Tarver LLP

(57) ABSTRACT

A face exercising device comprising: a stretchable mask having a central aperture for a wearer's face; two connectable top straps connectable behind the wearer's head for securing the top to the wearer's forehead; two connectable bottom straps for attaching the mask to the wearer's chin; and a top strap affixed to the top of the mask for attaching to the back of the wearer's head.

6 Claims, 5 Drawing Sheets

FACIAL EXERCISE MASK

FIELD OF THE INVENTION

The invention is directed towards a facial exercise apparatus. In particular, the invention is a facial exercise apparatus made of a flexible/stretchy material such as elastic, latex, spandex, PPR (a soft rubber material) or neoprene.

BACKGROUND OF THE INVENTION

Millions of people worldwide participate in physical exercise. While most people work on their abdominal muscles or cardiovascular system, few people concentrate on facial muscles. Yet those muscles are critical to health and well-being. Proper exercise of the facial muscles can improve dental health and minimize painful macro-facial conditions such as TMJ. Proper exercising of the facial muscles can noticeably improve physical appearance.

A number of patents have issued in the field of facial exercise apparatuses. All have typically included complex and uncomfortable structure and apparatus. U.S. Pat. No. 6,248,043 discloses an exercise device for exercising muscles of the face, jaw and neck, featuring an elongated strap with two releasable attachable ends and an elastic portion to provide resistance for muscle exercise. A visible scale to determine the force provided by the elastic portion through the provision of indicia on the exterior surface of the elongated strap which visually shows the increasing and decreasing stretch of the elastic portion.

U.S. Pat. No. 4,666,148 discloses a facial exercise mask includes an Air is pumped between the lining and the inner surface of the mask body to inflate the lining which provides the resistive force for the facial muscles to work against.

U.S. Pat. No. 6,277,053 discloses a chin and face toning strap including an elongated strap portion dimensioned for wrapping underneath a chin and atop head of a user. A pair of magnets are secured within the cheek portions of the elongated strap portion.

U.S. Pat. No. 6,179,747 discloses a one piece face and neck exerciser. A critical feature is a neck band to which two elongated beginners' neck resistance bands are attached into neck grooves extending outwardly and up to be permanently attached to the lateral sides of the chin cup. Increased resistance is provided by the use of additional resistance bands.

U.S. Pat. No. 6,152,857 discloses an apparatus for exercising the face and neck comprises a frame with multiple perforations in its upper and lower parts for fastening flexible bands of various size and elasticity horizontally, vertical or at angles to produce elastic resistance fields for receiving a person's face to exercise facial muscles. Two ocular accessories with adjustable sockets are positioned within the frame on the flexible bands for exercise of the opening and closing of the eyelid. Support and fastening elements firmly retain the bands and accessories in place on the frame for exercising the facial muscles. A portable version of the apparatus provides handles for manually controlling the muscular pressure of the flexible bands on the facial and neck muscles.

U.S. Pat. No. 5,728,028 discloses a facial mask, that when applied to the skin as a liquid latex formulation, will dry to a rubberized consistency creating a resistance to facial muscle movement similar to the resistance bands used in home exercise machines. This resistance is increased by adding additional layers of the mask. Once exercises are complete, the mask is removed by simply peeling it from the skin, leaving the skin feeling soft and muscles of the face feeling firm and taut.

U.S. Pat. No. 5,192,254 discloses a sensor device to detect and signal the exercise or movement of a subject's craniofacial and cervical muscles that includes a trigger attached to the subject, sensitive to movement in at least one direction and communicating with a signal emitter in order to emit an appropriate signal upon the sensing of movement that indicates the performance of the exercise.

U.S. Pat. No. 4,574,787 discloses an acupressure apparatus for applying vibrational pressure evenly to a plurality of preselected points on a shaded portion of a living body such as upon the face thereof includes a housing and a flexible membrane secured to the housing to form an enclosed chamber between the housing and the flexible membrane for containing therein a liquid U.S. Pat. No. 4,189,141 discloses an exercise mask which includes an externally convex mask body made of an elastic two-way stretch cloth material. A central face portion has holes for eyes, nose and mouth of the wearer. Massive lead or omnium weights are enclosed in pockets secured inside the mask at b row, temple, cheek, nose and chin portions. A sanitary, flexible removable liner may be inserted inside the mask body U.S. Pat. No. 4,892,092 discloses a facial mask for use in effecting isometric toning of facial muscles comprises a plurality of shaped pressure applicators located to overlie the termination points of selected facial muscles, and an expansible chamber located such that when the chamber is expanded, it causes the pressure applicators to apply pressure to the termination points of the selected facial muscles. The facial mask may further include a mouthpiece to be received in the user's mouth and to be bitingly engaged by the user's teeth for anchoring the user's mastication muscles and for tensioning the user's facial muscles around the lips during use of the device. The pressure applicators may also include surface electrodes for sensing EMG (electromyogram) signals produced by the muscles to provide an indication of whether the proper muscles are being exercised.

U.S. Pat. No. 4,823,778 discloses an exercise device including a series of stiffeners.

U.S. Patent Application No. 20040220445 discloses a flexible and elastic magnetic joint wraps incorporate super strong magnets with alternating polarities to provide enhanced magneto therapeutic effects. Magneto therapeutic joint wraps that are flexible and elastic incorporate super strong magnets in an attachably detachable manner so as to provide magneto therapy to joints and surrounding tissues. NEOPRENE.RTM. or the like may incorporate super strong magnets such as those based on iron (magnetic ferrite) or neodymium (particularly neodymium-iron-boron (NdFeB)) in order to provide super strong static magnetism by which magneto therapy may be affected.

While there have been a number of exercise devices on the market, the devices have included a variety of additional or complex mechanical structures or uncomfortable structures such as eye socket attachments.

It is an object of the present invention to provide a novel face exercising device.

It is another object of the present invention to provide a face exercising device which can be easily placed upon the face of the wearer.

It is a further object of the invention to provide a face exercising device which can be easily adjusted.

It is another object of the invention to provide a device which tightens and tones all major muscles of the face and neck. This includes the jaw line, forehead, cheeks, eyelids, around and under the eyes, around the mouth, under the jaw, and the front and back of the neck.

It is an object of the invention to provide a device which smoothes away wrinkles in all areas that it exercises, tightens and tones.

It is a further object to provide a system that lifts saggy or droopy skin in all areas that it exercises, tightens and tones.

SUMMARY OF THE INVENTION

In accordance with the present invention, a face exercising device comprising: a stretchable mask having a central aperture for a wearer's face; two connectable top straps connectable behind the wearer's head for securing the top to the wearer's forehead; two connectable bottom straps for attaching the mask to the wearer's chin; and a top strap affixed to the top of the mask for attaching to the back of the wearer's head and connecting to the top straps, whereby when the mask is affixed to the face of the wearer, the muscles of the wearer's face are held in place creating negative resistance when facial gestures and jaw movements are made.

In a further embodiment, the invention is a face exercising device comprising: a stretchable neoprene mask having a central aperture for a wearer's face; two connectable top straps connectable behind the wearer's head for securing the top to the wearer's forehead; two connectable bottom straps for attaching the mask to the wearer's chin; and a top strap affixed to the top of the mask for attaching to the back of the wearer's head, whereby when the mask is affixed to the face of the wearer, the muscles of the wearer's face are held in place creating negative resistance when facial gestures and jaw movements are made.

In still a further embodiment, the invention is a a face exercising device comprising: a stretchable neoprene mask having a central aperture for a wearer's face; two connectable top straps connectable behind the wearer's head for securing the top to the wearer's forehead; two connectable bottom straps for attaching the mask to the wearer's chin; and a top strap affixed to the top of the mask for attaching to the back of the wearer's head; and a cavity on the inside of the mask to hold a moisturizing cream, whereby when the mask is affixed to the face of the wearer, the muscles of the wearer's face are held in place creating negative resistance when facial gestures and jaw movements are made.

In still a further embodiment, the face exercising device comprises of a mask made of stretchable material that when fixed tightly on the wearer's face, holds all of the facial muscles in place; such that when facial gestures and jaw movements are made, the facial muscles remain fixed in place by the stretchy matter, thus creating a negative resistance to the facial muscles that, in effect, exercises, tightens and tones the muscles of the face.

DESCRIPTION OF THE PREFERRED EMBODIMENT

Figure 1:
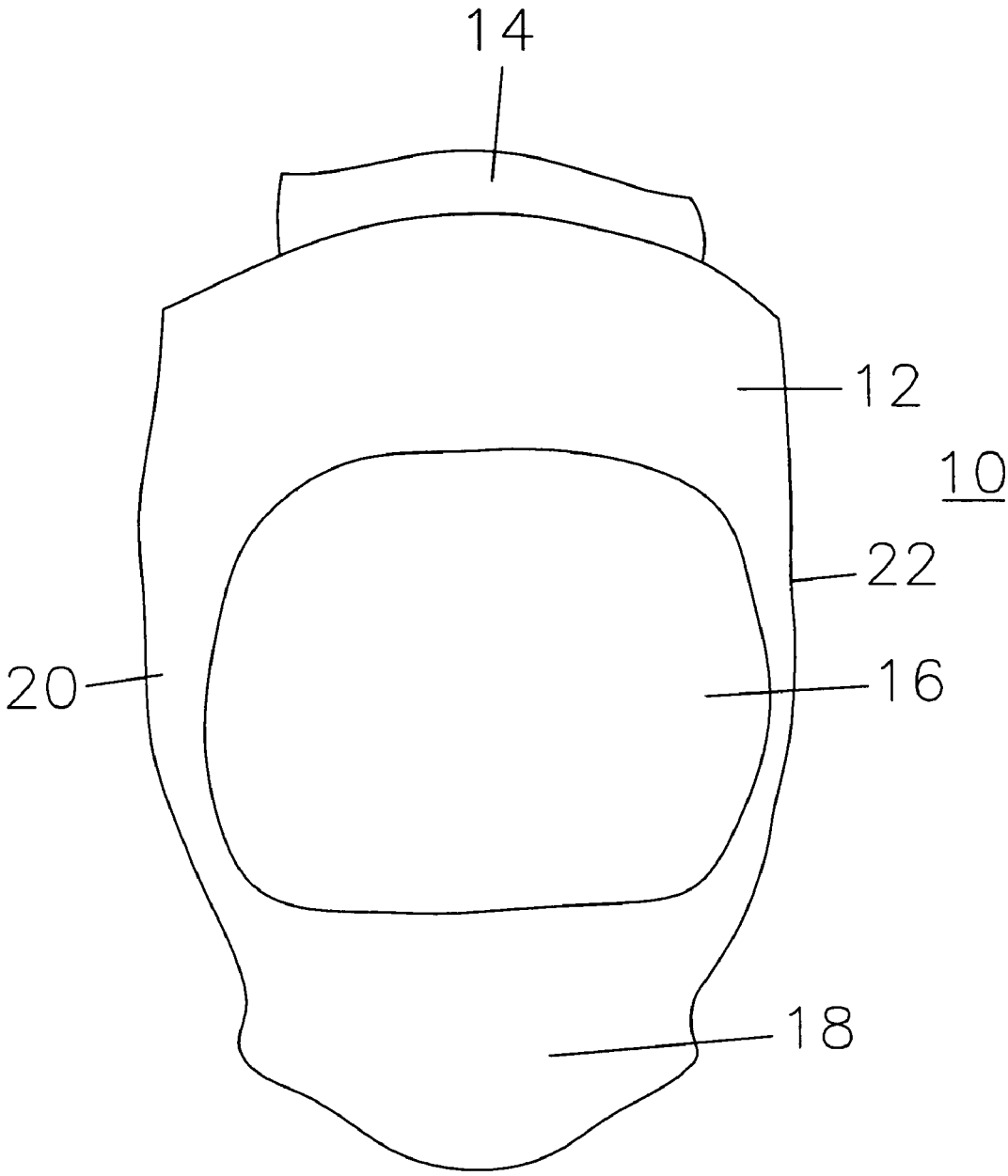
FIG. 1 is a front perspective view of the present invention.
Figure 2:
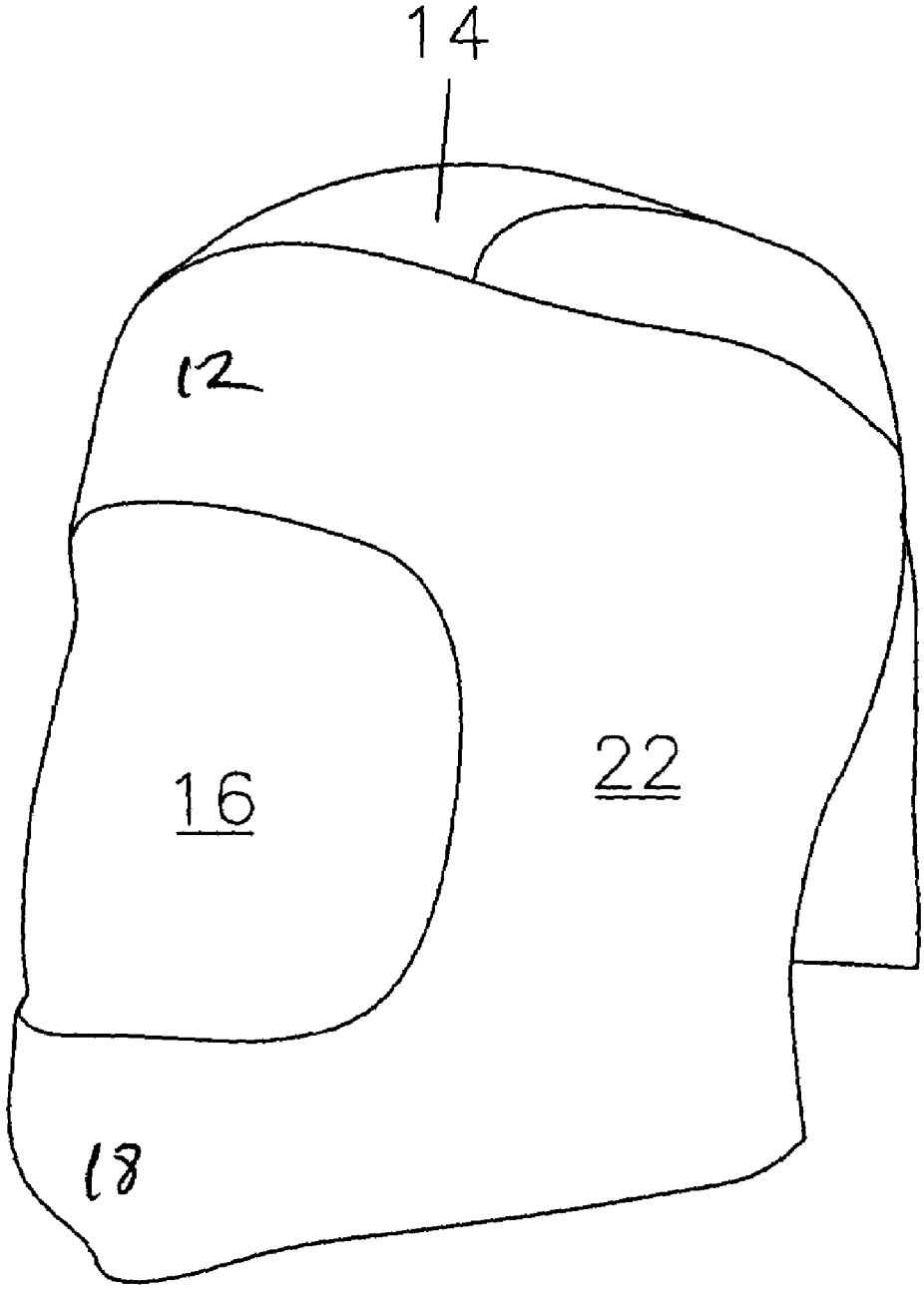
FIG. 2 is a side perspective view of the invention.
Figure 3:
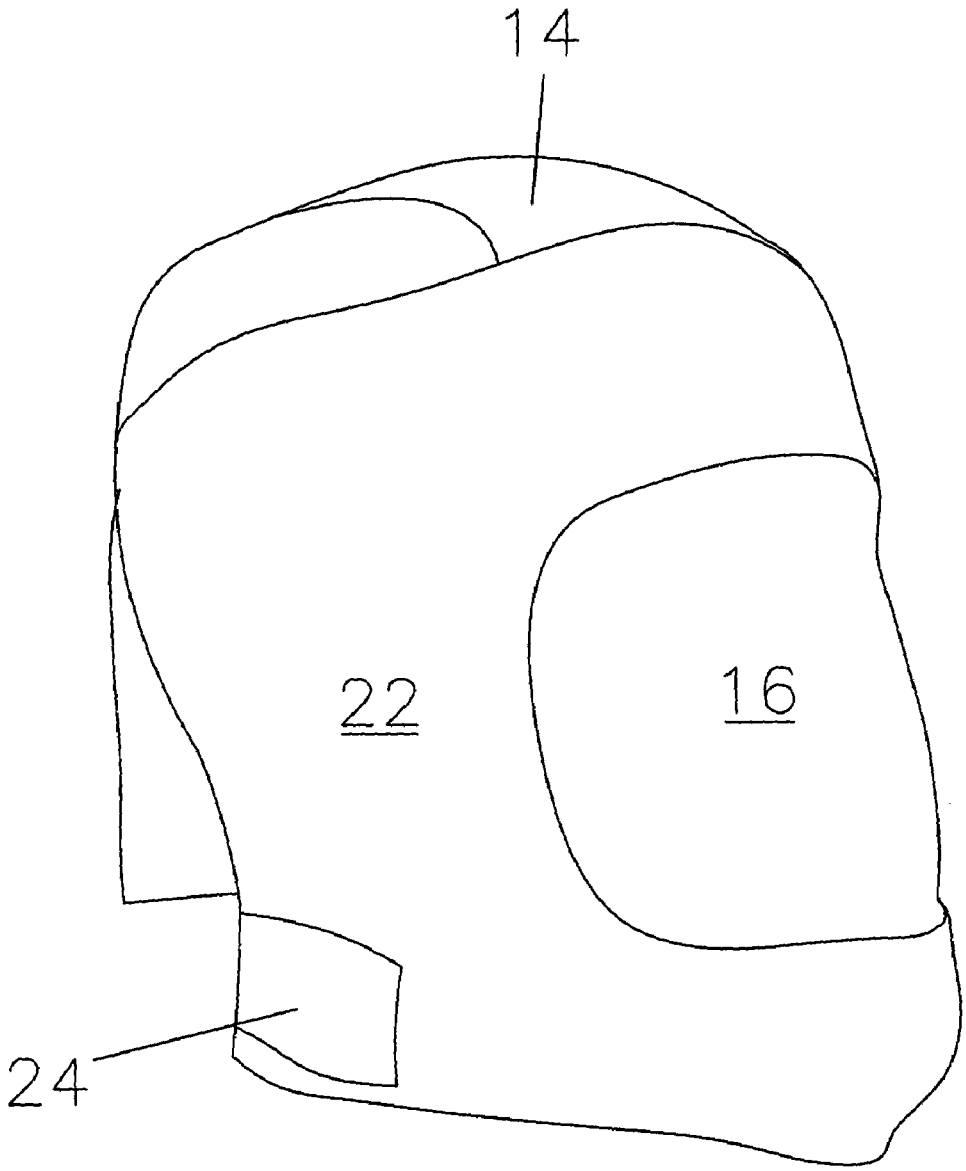
FIG. 3 is a alternative side view of the present invention.
Figure 4:
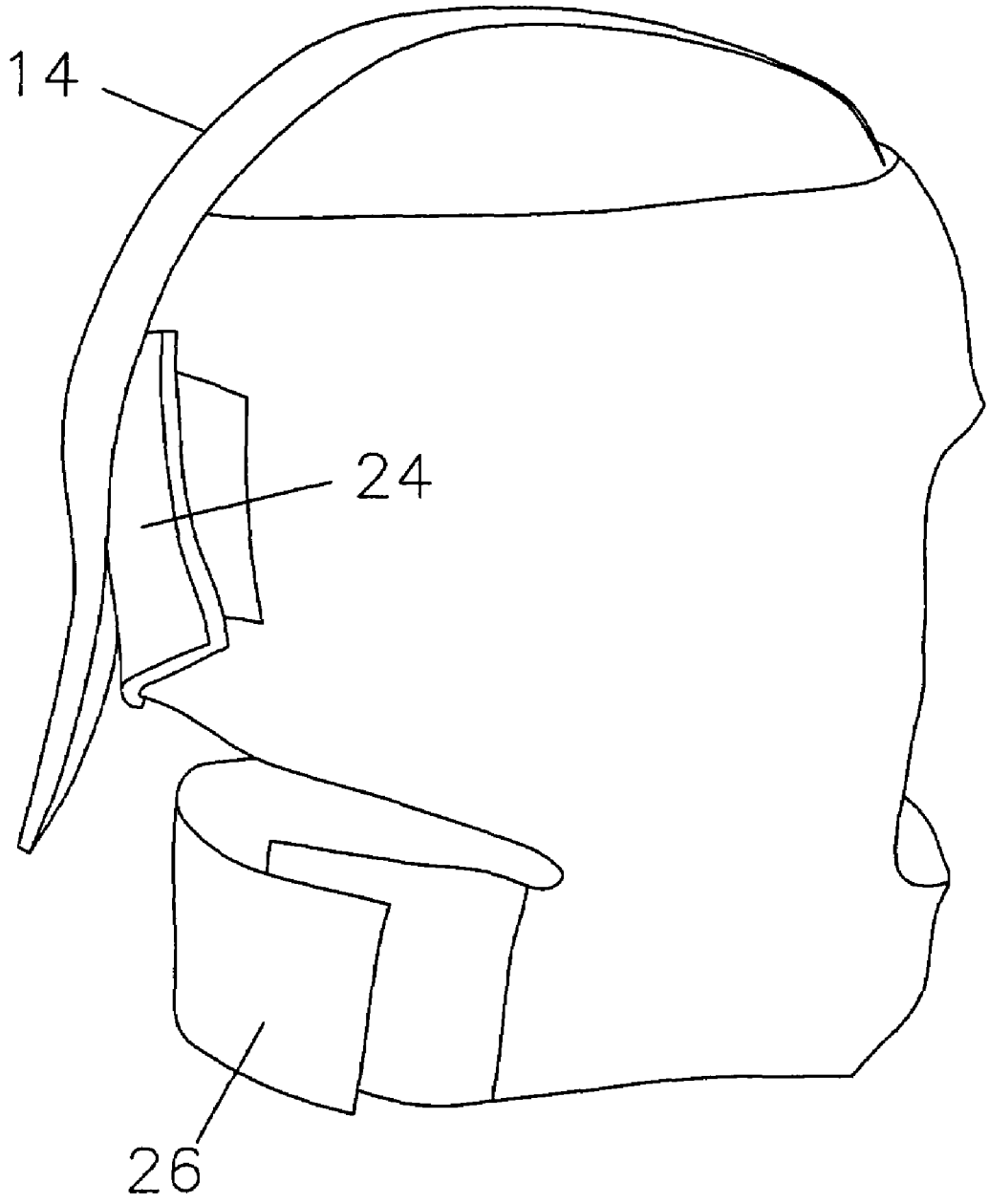
FIG. 4 is a rear perspective view of the present invention.
Figure 5:
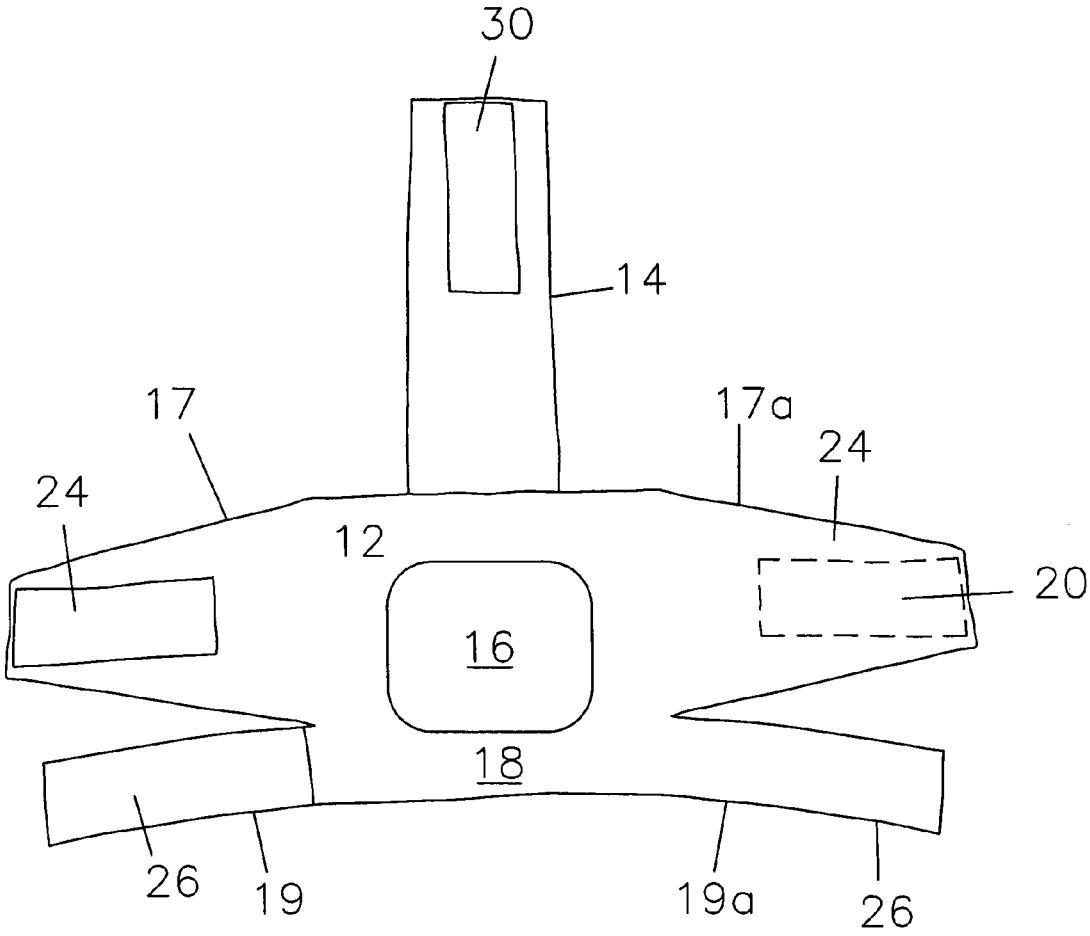
FIG. 5 is a perspective view of the present invention.

The present invention is described with reference to the enclosed Figures. Referring to FIGS. 1-5, the invention comprises a stretchable mask 10. The mask 10 has an aperture 16 for the face of the user. The mask forms a frame around the face of the wearer and forms a top frame 12 and bottom frame 18. The mask includes two side strap pairs. The top strap 17, 17*a* attach to frame 18 around the side of the user's face and connects via a connection mechanism. The bottom panel pair 19, 19*a* connects around the chin of the wearer at 12 and connects at the nape of the neck via a second connection mechanism. A top strap attaches over the head of the wearer and at the user's neck.

The mask is preferably constructed of a flexible/stretchy material such as neoprene, elastic, spandex, latex, or PPR (a soft rubber material). The side panels are adjustable and have Velcro sewn on them to hold the mask in place. Buckles, snaps, or buttons may also be used in place of Velcro on the straps.

There are three steps to strapping on the product: First, stretch the top panel pairs around the back of the head and Velcro them onto each other. The eyes must be visible through the large circular opening in the front. Second, stretch the top strap over the head and Velcro it down onto the middle straps. Make sure the skin of the forehead is slightly lifted and snug. Third, stretch the lower panels and attach around the back of the neck, just below the head, and attach them together. The chin straps are separate from the other straps. The mask may comprise a one piece or multi piece configuration or assembly. In this regard, the mark may be separatable and detachable. There may also be openings as an array of small holes or openings proximate to the ears.

In operation, the invention exercises, tightens and tones all major muscles of the face and neck. This includes the jaw line, forehead, cheeks, eyelids, around and under the eyes, around the mouth, under the jaw, and the front and back of the neck. The invention releases and smoothes away wrinkles in all areas that it exercises, tightens and tones and lifts saggy or droopy skin in all areas that it exercises, tightens and tones.

Best results are achieved when used a minimum of 10 minutes per day, and should be used no longer than 15 minutes at a time. Making facial gestures while the product is in place creates a negative resistance on the muscles of the face that will exercise, tighten, and tone. The chin strap adds resistance to the jaw as the jaw is opened and closed. This exercises the jaw and neck area when movements are made with the jaw.

The inside of the product may be coated with a special formula that seeps into the skin during use, in order to help relieve wrinkles and tone the skin. Magnets may be placed inside the product over the acupressure points of the face in order to aid in relieving wrinkles and toning the skin. The inside of the product may have small pockets to hold facial cream. The cream would seep from the pockets into the skin as the product is being used. The inside of the mask also can be coated with an anti wrinkle cream.

The present invention has been described with reference to the enclosed preferred embodiment. It is to be appreciated that the teachings of the present invention are applicable to a wide variety of instrumentalities. The true nature and design of the patent is to be determined with reference to the claims attached hereto.

What is claimed is:

1. A method for exercising facial muscles of a user comprising the steps of:

a. providing a stretchable neoprene mask having a single central aperture configured for exposing and constraining a wearer's eyes, nose and mouth, said aperture configured for bounding a wearer's brow line at the top of said aperture and a wearer's lower lip at the bottom of said aperture; said mask including two overlapping upper side straps having one end attached to said mask and a second end configured for connection behind the wearer's head at the rear of the wearer's skull, and including means for allowing sound to pass through an area of said straps adjacent a wearer's ears; said mask further including two overlapping lower side straps having one end attached to said mask and a second end configured for connection behind the wearer's neck; said mask having a top strap affixed to the upper area of said mask adjacent the crown of a wearer's head for overlapping said upper side straps behind a wearer's head;

b. placing said mask over the face of a wearer;

c. stretching said two overlapping upper side straps around the back of the wearer's head; positioning said mask near the eyes of a wearer along the top of said central aperture;

d. stretching said top strap over the top of the wearer's head and affixing said top strap to said two overlapping upper side straps;

e. stretching said two overlapping lower side straps around the back of the wearer's neck;

f. moving a wearer's facial muscles by making a plurality of facial gestures and jaw movements to deform the mask, whereby when the mask is secured to the wearer's face, the facial muscles are resiliently restrained by the stretchable neoprene mask, creating negative resistance to the wearer's facial muscles while performing a series of predetermined facial exercises;

g. said mask includes a coating on an internal side of the mask adjacent a wearer's face.

2. The method of claim 1, wherein the device includes a chin strap.

3. The method of claim 1, wherein a series of predetermined exercises are performed for no longer than 15 minutes at a time while wearing the mask.

4. The method of claim 2, wherein a series of predetermined exercises are performed for a minimum of 10 minutes per day.

5. The method of claim 1, wherein the inside of the mask is coated with a wrinkle relieving formula.

6. The method of claim 1, wherein the inside of the mask comprises pockets to hold facial cream.

* * * * *